United States Patent [19]

Shettel

[11] 3,952,522

[45] Apr. 27, 1976

[54] IRRIGATION SYSTEMS AUTOMATION

[76] Inventor: Ralph E. Shettel, Rte. 1, Twin Falls, Idaho 83301

[22] Filed: Nov. 19, 1971

[21] Appl. No.: 200,410

[52] U.S. Cl. ..... 61/29; 61/12; 251/147; 256/32; 210/154

[51] Int. Cl.[2] ..... E02B 7/20; E02B 13/00

[58] Field of Search ..... 61/29, 24, 25, 27, 28, 61/12, 13, 22; 251/147

[56] References Cited

UNITED STATES PATENTS

| | | | |
|---|---|---|---|
| 42,761 | 5/1864 | Griggs | 61/24 |
| 614,675 | 11/1898 | Tilton | 61/25 |
| 782,390 | 2/1905 | Hansen | 61/24 |
| 1,039,072 | 9/1912 | Edge | 61/25 |
| 2,584,364 | 2/1952 | Osborn | 61/29 X |
| 3,114,243 | 12/1963 | Winters | 61/29 X |
| 3,300,985 | 1/1967 | Humpherys et al. | 61/25 |
| 3,326,002 | 6/1967 | Halpenny | 61/28 |
| 3,338,057 | 8/1967 | Eckstine | 61/25 |
| 3,354,655 | 11/1967 | Armond | 61/28 |
| 3,401,527 | 9/1968 | Palmer et al. | 61/28 |

*Primary Examiner*—Jacob Shapiro

[57] ABSTRACT

An irrigation system innovating manual practices and method elevating channeled waters for a diversion to the land. A check means locating in the ditch cooperating with a metering valve means locating in the ditch bank for the regulation and distribution of waters to thereby produce and reproduce selective and known volumes. A ditch valve means automating a diversion through selective preset comprising a metering insert and conduit combination. A check means incorporating a movable lower panel portion of reduced area minimizing actuation loads depending from an upper stationary dam portion having a spillway elevating a mounting base for the location of controls and actuators, clear of checked waters. A check means balancing a diversion through lower panel manipulations, while providing for the controlled release of accumulated water. A check means flexible by degree to automating combinations of actuators, timers and remote control, while incorporating portability for multiple use and storage.

25 Claims, 21 Drawing Figures

INVENTOR

INVENTOR
Raine E. Shetler

INVENTOR
Ralph S. Shutt

INVENTOR

Ralph E. Shetley

INVENTOR
Ralph S. Thorp

INVENTOR
Ralph E. Ohlerf

INVENTOR
Ralph E. Shutral

IRRIGATION SYSTEMS AUTOMATION

The invention relates to gravity irrigation systems and the common diversion technique of checking waters for their distribution over farm and ranch lands. The particular diversion shown requires that the ditch or channel be obstructed to force water up and out ditch bank take out openings or notches, with a balancing procedure effecting a measured flow. A set made by the best irrigator has always been subjected to orifice alteration by a continuing erosion, plugging by water born trash and human error. The problem is extended through the use of excessive water volumes to make sure all the land gets wet, especially in earth ditch and shovel cutout systems. There exists, then, a need for better volume identity and control, be it the right volume for any particular soil, crop or season, or the duplication of that volume.

Innovations of the past have produced improvements in the form of ditch liners and miscellaneous checking and take out structures. Though the irrigator may always be required to make appropriate water volume determinations, to one way or another respond the ever changing conditions in the field, his labors will be eased by the developments herein revealed that make water regulation selective and known. This can be the first object of the invention.

Another object of the invention is to progressively innovate a developing irrigation system into the complete automaton that will employ centralized master programing and cycling incorporating field sensory and sequent anticipation to promote plant life while reducing manual labor.

A final object of the invention is to perpetuate system operational function through component water screening and irrigation line fencing.

These and other objects and advantages exist in the basic embodiment of the invention named by the specification taken in conjunction with the cooperate drawing, wherein like numerals refer to similar parts throughout, and in which:

FIG. 8 is a perspective view of a powered segment checking structure;

FIG. 8A is a side elevational view thereof;

FIG. 8B is a view of the segment clutch means;

Figure 1:
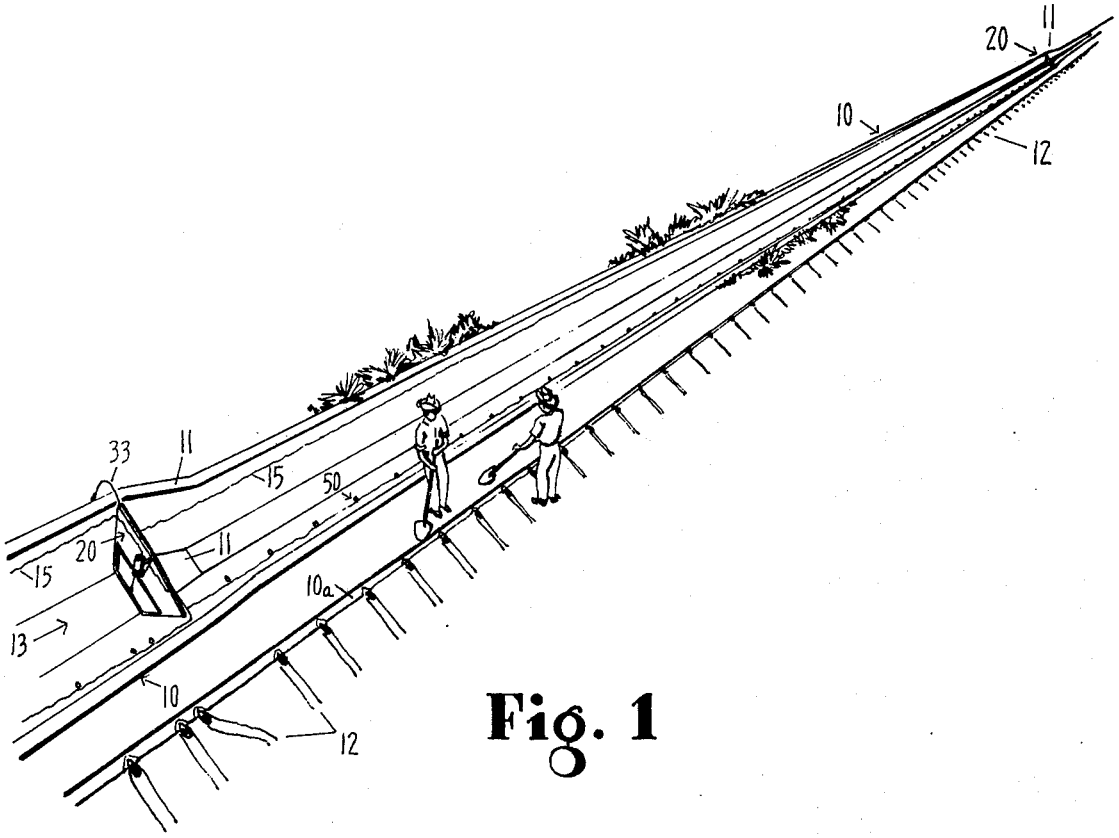
FIG. 1 is a perspective view of the diversion process.

Returning to FIG. 1 of the drawing, the preferred basic checking practice is depicted as effecting the systematic diversion with ditch 10 forming minimal fall basins between drop means 11, which make up terrain grade differential. The basin approach simply requires that the least number of check mechanisms serve the maximum number of metering valves, shown perforating the ditch wall at 50. Check station spacing should reflect given head water capacities, in all cases, and is criteria in eliminating the unwanted labors in valve manipulation, for too long a basin requires that a plurality of valves be manually shut off in order to maintain conduit submergence, as at 49 of FIG. 2. Any such manual interference severely limits the potential for a complete automation and is to be avoided. Valves 50 serve to meter water through selective preset, as will be later shown. Corrugates 12 are suggested only as one of the means for getting water through the field. Head waters, or flow direction, is indicated by an arrow and the numeral 13. Checked water is given numeral 15.

Figure 2:
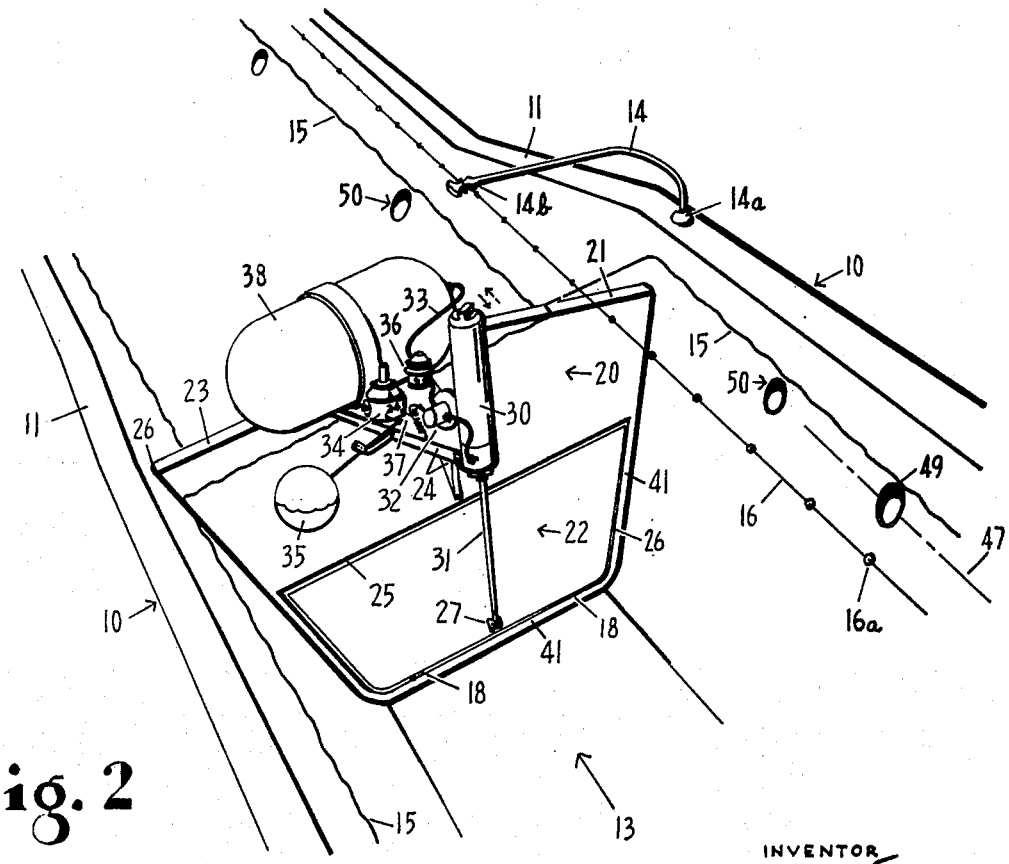
FIG. 2 is a perspective view of a checking structure including powered lower panel, hinged actuation.

The checking structure of FIG. 1 is shown in greater detail in FIG. 2. Dam 20 is a stationary upper portion of the check suitably located between the ditch walls to clear passing waters 13, as in FIG. 2B. The size and position of dam 20 also serves to continue the elevation of waters initiated by the closing of panel 22, and a sustained and stabilized submergence of valve line 47 is the primary duty of the check structure. Seals against seepage are indicated typically throughout the drawing by the numeral 26. A portion of the top surface of dam 20 is seen to cant downwardly to form spillway 21. The remaining top surface serves as an elevated mounting base for control and actuator components, as at 23, free of submergence. The mounting base can be enlarged and extended to meet that need, as at 24. Framework 41 is a planar extension of the surface of dam 20, and can be secured to ditch 10. Lower panel 22 is adjustable and depends from the bottom surface of dam 20 with a suitable water tight hinge means providing it attachments, as at 25. A closing contact with framework 41 is eased by bearing pads 18 which space the structures and minimize binding and wedging under water pressure. For manual operation, mounting base extension and bracket 24 supports and positions control 28, while permitting the function of lower panel 22, of FIG. 2B. From suitable attachments thereto, as at 27, control 28 extends upwardly to clear checked water with handle 29.

A continuous charged wire fence line positioned over the ditch system will protect the equipment. As shown, a curving post 14 supports a charged strand 16 to repel cattle and the like. In some cases, a double fencing system may be indicated by field conditions. Fencing strand 16 includes a plurality of smooth protuberance contacts 16*a* (named by U.S. Pat. to Shettel, No. 3,690,618) that minimizes injury and snagging. The strand wire is also gauged small enough to break under the excess stress of entanglement. Fence line tension is provided by hand and maintained by warping the posts slightly as the installation progresses. Post spacing is responsive to tension requirements.

Since dam 20 serves only to extend the checking surface of lower panel 22, and has been shown to clear passing waters with the check at rest, it is excused from any actuation consideration. In reducing the structure acted upon, smaller loads permit smaller actuator components and expense while producing the same end result. Also, stationary mounting base 23 permits diverse actuator component arrangement and portability.

Figure 2B:
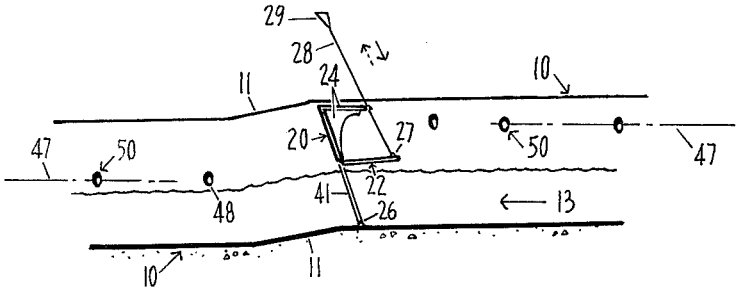
FIG. 2B is a side elevational view showing manual operation of the hinged panel.

Automation is progressed when control 28, of FIG. 2B, is replaced by the pneumatic ram actuator means, of FIG. 2. Although air is described, the system is convertable to hydraulics. The adaptation of motors and worm gears cooperating with a control rack means, and the incorporation of activator solenoids is anticipated with the availability of electrical power. The ram installation includes cylinder 30 which is positioned uprightly on mounting base extension 24 to pivot and aline its piston 31, through suitable connections as at 27, for the function of panel 22. Mounting base 24 is also expanded to provide for the relative positioning of the component assembly consisting of a directional valve 32, a timer means 34, a pressure regulator and an accumulator 38. Cylinder 30 is preferably valved for speed control to thereby slow the actuation and the release of accumulated water, and all components are appropriately plumbed together. Receiver or accumulator 38 is sized to power the seasonal pressurizations of cylinder 30 and is rechargable for reuse. The installation of the check structure can offer portability through the use of ditch attachments that permit removal, while serving to spot relocation relative to the line of metering valves 47. Cylinder 30 is shown to be reverse single acting and single acting, with or without stroke adjustment, or double acting as the need developes. Drains, filters, traps, reservoirs, lubricators, gauges and so on form a complete installation and are included as responding individual system function.

Figure 3B:
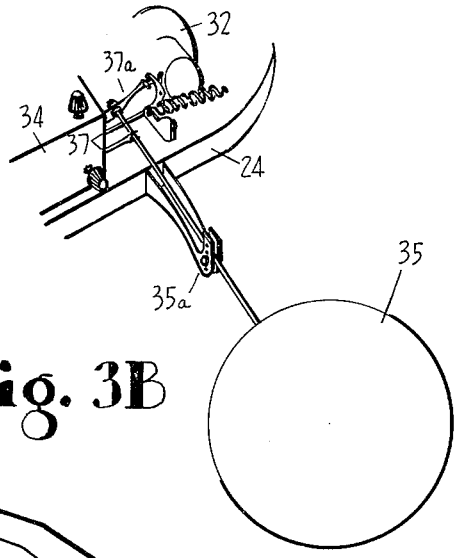
FIG. 3B is an enlarged detail of the float activated balancing means.
Figure 3:
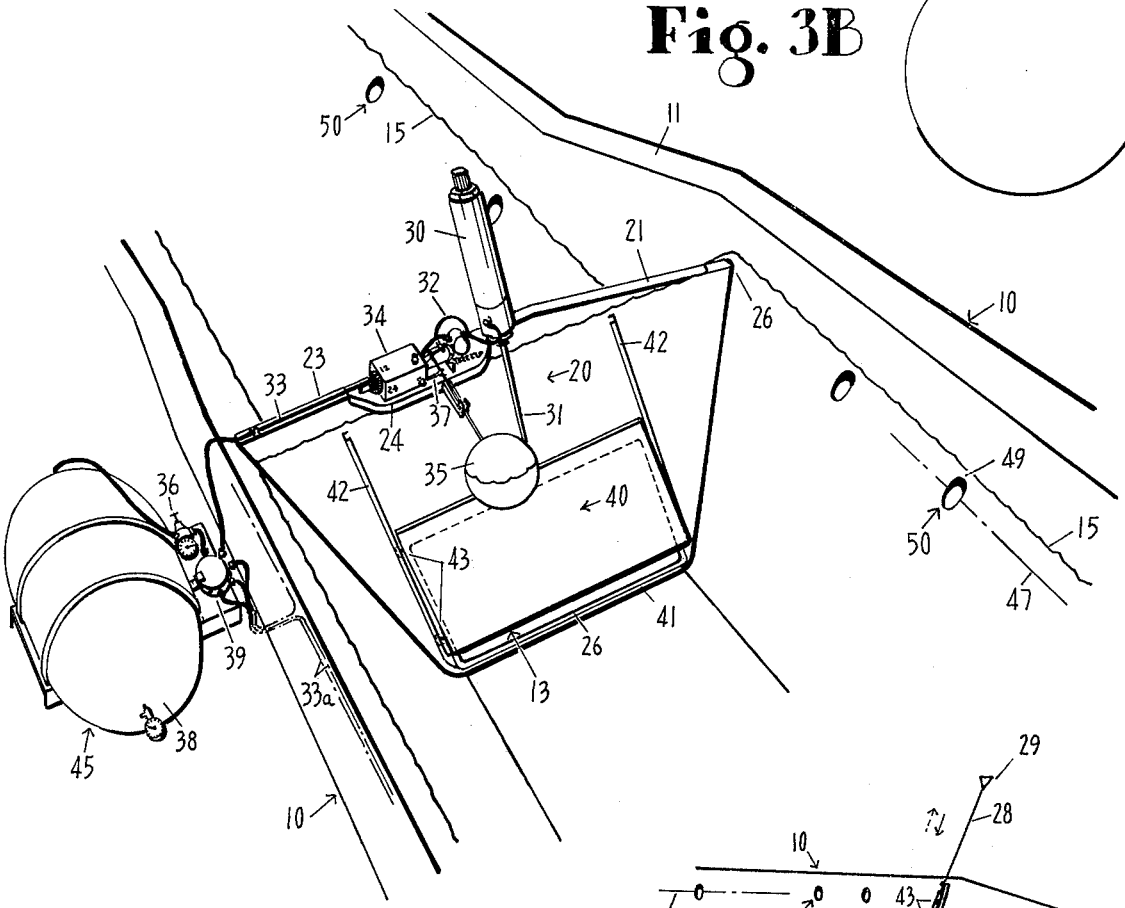
FIG. 3 is a perspective view of a checking structure including powered lower panel, vertical sliding actuation.

For the particular disclosures of FIGS. 2 and 3, directional valve 32 is activated in the hand winding of timer 34 for the release of piston 31 and panel 22 drops closed to check water. The hand winding and selection of the irrigation interval is a manual involvement that can proceed well in advance of working head waters, and is not necessarily excessive over the seasonal need for adjusting metering valves 50 to meet the changing irrigation demands, as efficiency dictates. A building water level buoys float 35 to activate timer 34 through linkage 37 to start measuring the irrigation interval. Float activation of the irrigation cycle could be replaced by a water powered activator means levered by the spill of water. Many such adaptations incorporating water power, air power, float power and mechanical advantage exist in this presentation as having application to any of the related views. For an opening actuation of panel 22, timer 34 activates directional valve 32 as a reaction through interconnecting linkage 37*a* to cycle the sustained pressurization of cylinder 30. Panel 22 is slowly raised to the open position which releases all water to succeeding check stations down the line free of surge and flooding.

Figure 3A:
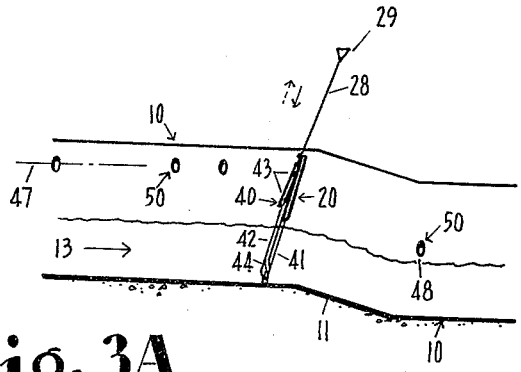
FIG. 3A is a side elevational view thereof.

The basic check structure, the ram actuator and cycling means described for FIG. 2 are included in the check of FIG. 3. In this case, lower panel 40 is vertically sliding and rectangularly shaped to act over framework 41 and against seal surround 26. Side track members 42 suitable affixed there and over dam 20 contain the movement of the end roller portions 43 depending from the sides of panel 40. Track 42 is seen in FIG. 3A to have a niche as at 44, into which bottom roller offset drops for a panel closing. Conversely, the realized initial break-away opening action, which is slightly exaggerated in the view for clarity, produces free travel for selective vertical positioning. The top rollers are set for panel to seal frictional contact. Mounting base 24 receives the actuator components of FIG. 2 with these changes. Cylinder 30, again, is positioned uprightly to aline connections permitting the function of panel 40. Check slope and water pressure work in producing an upward thrust which favors an opening actuation. From directional valve 32, a feed line 33 traverses mounting base 23 to make connections with a power package 45 located on the ditch bank. The power package is portable for multiple use and storage, and includes a pressure regulator with gauge 36, a receiver 38 and manifold 39. Receiver 38 is sized to meet the seasonal requirements of a plurality of checking stations up and down the irrigation line. The many feed lines 33*a* emitting from manifold 39 are routed accessible in the ditch excavation prior to the laving of the liner, that is near the top.

Automaton is progressed further when float 35 acts to monitor high water for the stabilization of metering valve submergence, and this need not be too refined. Head water volumes fluxuate with waste water infiltration, variety in check position in the irrigation sequence from set to set, and the effect of seasonal take out by the metering valves. The buoyancy of float 35, FIG. 3B, functions through its arm and linkage 37*a*, in mechanical advantage, to activate directional valve 32 for the limited pressurization and rest of cylinder 30, as responding a changing water line. Lower panel 'crack' passes an amount of water responding the up pressure on float 35 until relief levers a neutral position of rest. Too low a water line signals a closing and the process is repeated until an acceptable stabilization is realized. Such balancing produces and reproduces an identity in valve pressure head 49 that relates from one irrigation to the next, or from one set to the next. Metering potential is standardized for any one valve setting. The position of the float arm is selective in its support, as at 35*a*, to permit more or less pressure head, or volume potential, over the valves.

Figure 4:
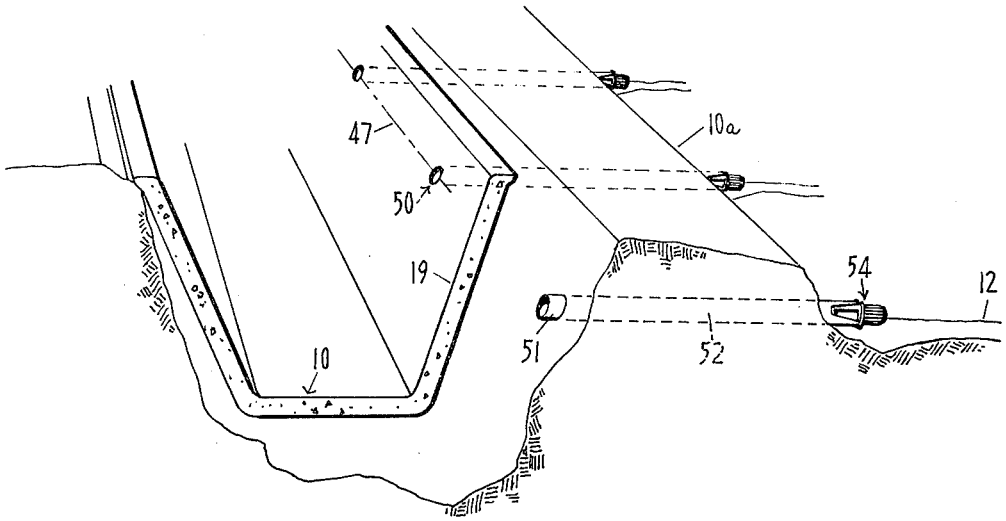
FIG. 4 is a sectional view of a modified ditch liner configuration, including conduit placement.
Figure 4A:
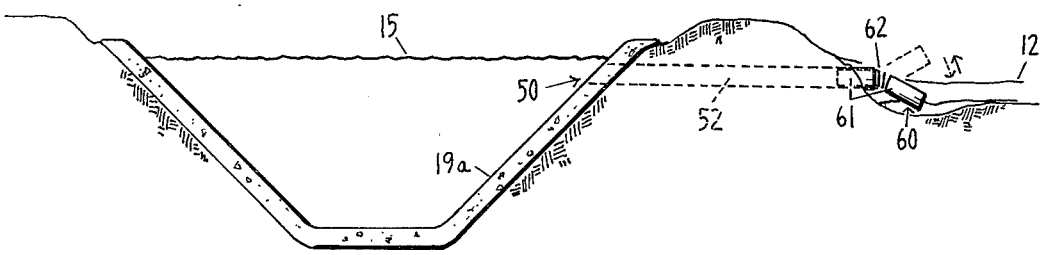
FIG. 4A is a sectional view of a conventional ditch liner configuration, including jointed tube insert metering.
Figure 4C:
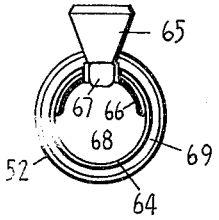
FIG. 4C is a front elevational view thereof.
Figure 4B:
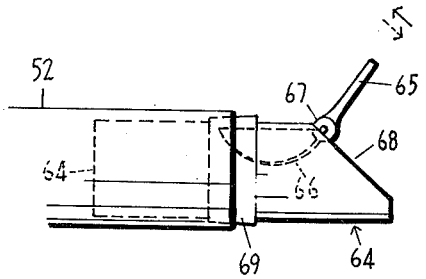
FIG. 4B is a side elevational view of the flapper metering insert.

Conventional lined ditches have a section which includes a 45° sidewall slope 19*a*, of FIG. 4B, and excessive water accumulations. This is undesirable and complicates the check actuation through inherent larger pressure loads to be overcome. The preferred ditch section of FIG. 4 eliminates that excess. It is seen to have a more upright sidewall slope 19 that reduces pressure loads by a fourth or more. Check structure and actuation loads are proportionally reduced. This more efficient ditch section is included in the drawing as benefiting the checking operation.

The regulation of waters to the land is handled by the metering valves 50 appearing in each of the checking views. Line of valves 47 behind any one check radiates from spillway 21, and is level for equal submergence of the valves under the level checked water line 15, as in FIG. 3. The resulting related submergence produces related preset metering and known flow volumes automatically. It is intentional that the check structure be spared that much intricacy and complexity for obvious reasons. The lowest valve in the line of valves must clear passing waters, as at 48 of FIG. 3A, to eliminate between irrigation dribble. Again, to disturb valve preset is self-defeating. Valves 50 can be equally spaced for a uniform distribution or sized and grouped for a diversion serving whatever purpose.

Much labors and frustration have been companion to the task of perforating new, and especially existing, ditch liners for the conduit installation. It is desirable to simplify that operation whatever the liner material. After the trench work excavation is completed, the line of valves 47 is layed out behind the established checking position. Working conditions are immediately improved since the overlaping concern for the liner has been eliminated from that phase of the work. Conduits 52, of concrete, plastic, metal or other suitable material, are driven into the earth bank, including an appropriate fall, to project an amount perforating the laying of the liner, as at 51. A ditch bank cut, as at 10*a*, before the conduits are set will allow automatic outlet exposure. Conduit position is fixed by the liner and a neat perforation is realized. Earth is augered from the conduits and, at worst, a little spade work finishes the job. The metering of water is accomplished by an insert of the type shown in FIGS. 4A, 4B, and 4D, which cooperate with the conduit extremity to thereby escape operational interference from materials abutting the conduit. In FIG. 4A, insert 60 is shown as a tube member 61 with intermediate flex joint 62. Through an elevation manipulation, head pressure, or fall, is varied to produce a metered flow or shutoff. In FIGS. 4B and 4C, insert 64 is seen to have a depending flapper portion 66 which is selectively positioned by a projecting tab 65 to obstruct the flow of water through the valve assembly for metering and shutoff. Flapper 66 is arched to nest against the insert wall and thereby provide a full opening. Attachments to the conduit at 57 are frictional and maintain flapper position with tab projection establishing relative metering. A perimeter seal means 69 can close insert installations against seep, or make up tubing size differential. It is desired that the inserts be removable for cleaning and off season storage to thereby permit easy maintenance and free use of the land.

Figure 5:
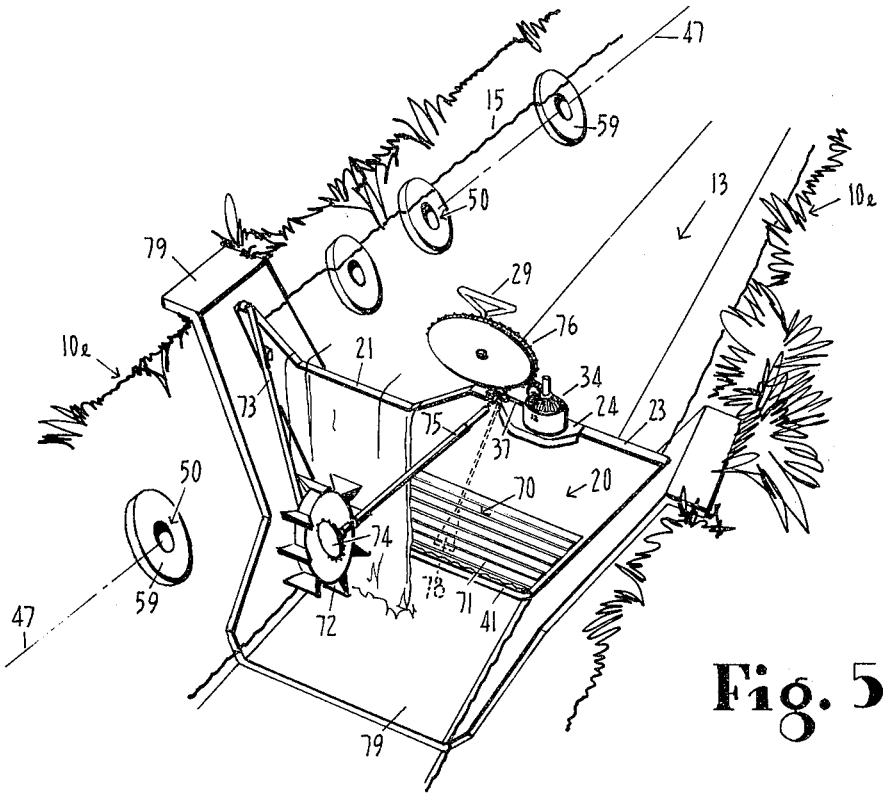
FIG. 5 is a perspective view of a checking structure including powered lower panel, roll-up actuation.

Of course, installations of concrete and metal would better withstand weed burning and other related practices common to the field. Installations incorporating plastic in various ways is anticipated. In FIG. 5, the metering valves set in earth ditch 10*e* are most vulnerable to a displacement that disrupts their identity. Collar 59 will provide the mass that can establish position while providing separation from vegetative growth. Perforated discs of concrete are particularly appropriate.

Figure 5A:
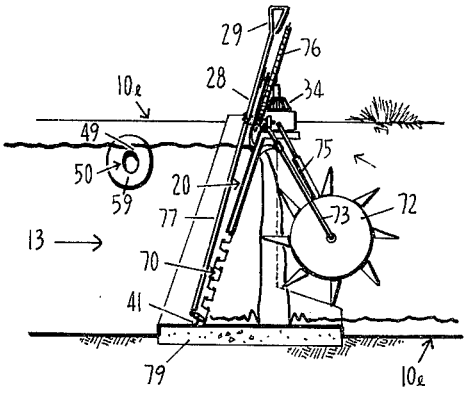
FIG. 5A is a side elevational view thereof, spill powering the actuation.
Figure 5B:
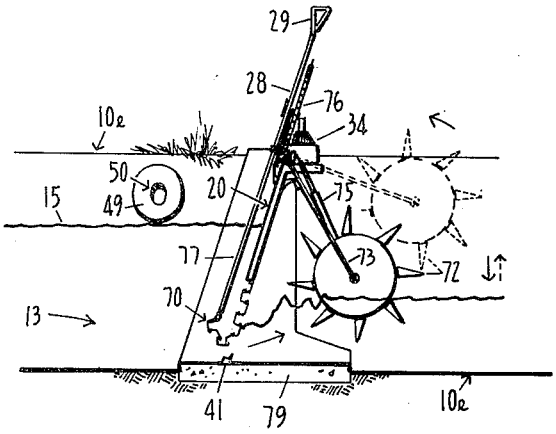
FIG. 5B is a repeat view, release of accumulated water powering the actuation.

Continuing with FIG. 5, the paddle wheel actuator named under patent to Shettel, 3,693,357, is adapted to mounting base 23 and its structures modified for use downstream. Stationary dam 20 permits this arrangement. An actuation is realized which utilizes the power in spilling water, as in FIG. 5A, and the power in the release of accumulated water, as in FIG. 5B. The particular installation shown is made in earth ditch 10e incorporating a transverse segment portion of the liner, as at 79, including an apron extension for spilling water, or a drop structure. The liner configuration is perpetuated to permit multiple use and standardization of the checking means. Spillway 21 is shaped to centralize spill over paddle wheel 72. Lower panel 70 exists in a plurality of interacting channel members 74 with flexible seal joinings, or overlaying a membrane backing for seal and relative positioning. A roll up actuation or segment opening is realized which fragments water pressure and seal loads to ease an actuation. The paddle wheel is a self-contained-float which buoys the mechanism to a changing water line, as in FIG. 5B. Gear clusters 74 and 76, in mechanical advantage, are at the extremities of mobile driveshaft 75, which transforms paddle wheel drive to control rack 77. Gear cluster 76 alines mounting base 23 while cooperating with driveshaft 75 for selective mesh through longitudinal displacement of the driveshaft extremity. Other principal functions include a water powered trip means 78 cycling a panel closing through drive disengagement, and a timer means 34 cycling a panel opening actuation through drive engagement.

Figure 6:
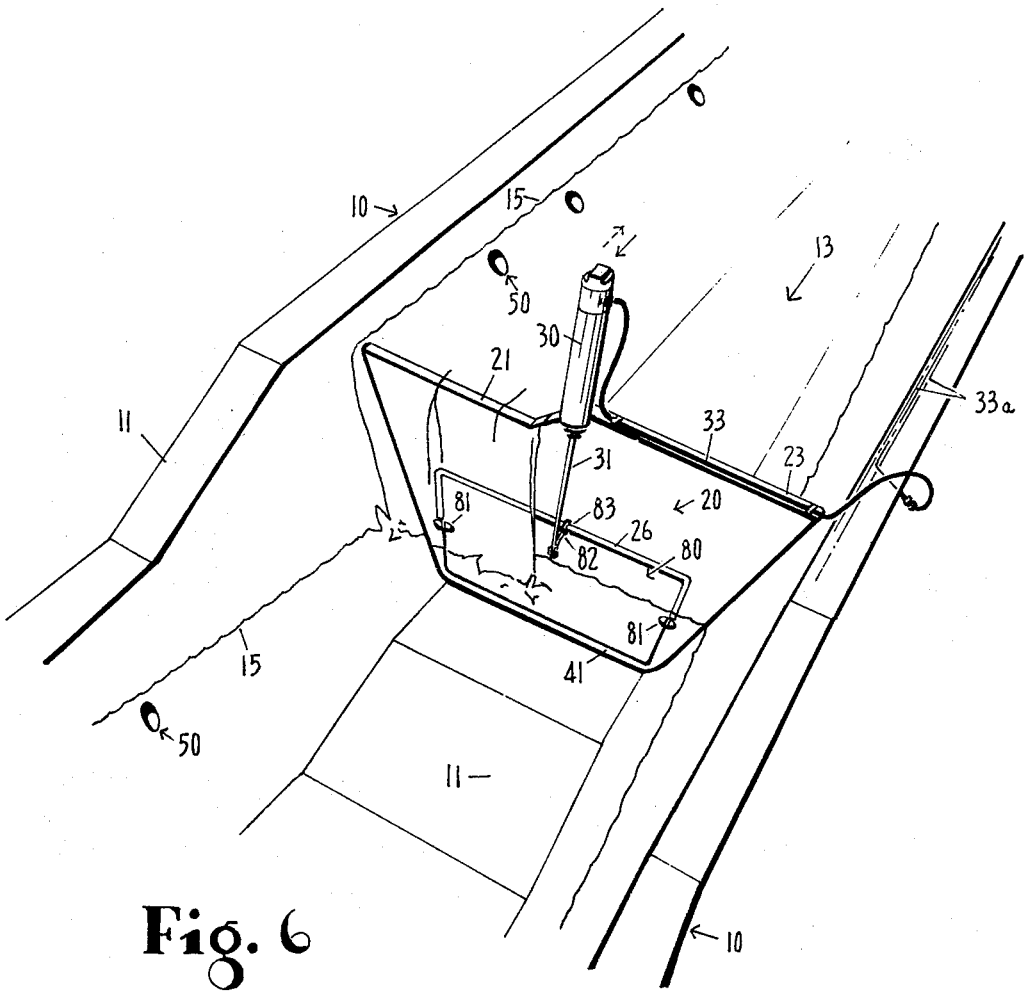
FIG. 6 is a perspective view of a checking structure including powered lower panel, horizontal pivotal actuation.

In FIG. 6, the basic check structure, the ram actuator and cycling means described for FIG. 3 is modified to produce a check having a lower panel 80 which acts horizontally over central pivots 81 affixed to side framework 41. Spillway 21 forms a trough for increased overflow. Panel 80 enjoys a reciprocating water pressure effect that minimizes initial actuation loads. Cylinder 30, shown single acting, is positioned uprightly to pivot on mounting base 23 with its piston 31 acting downstream and through suitable attachments with lever arm 82, which projects rearwardly from panel 80, to throw the actuation off dead center, as in FIG. 6A. Lever 82 can latch to the dam structure in the closed position, as at 83, and gain support that will insure negative seal contact under pressure. In this case, a closing is initiated by the spring return built into cylinder 30. In FIG. 6B, pivots 81 are placed slightly off center to cause water pressures working over the resulting unequal surfaces to produce a one way actuation. As shown, a closing is favored since surface 85 is larger. This leads the way to hydrostatic dampering, or a panel actuation by water pressure differential. The development of such panel surface area manipulations is seen to involve segment portions like those described for FIGS. 7A and 8.

Automaton is perfected when the supporting components are assembled as a centralized check controlling sequent means which offers complete remote control cycling and recycling responsive to sensory feedback monitoring field moisture and temperature levels for cycle preemption perpetuating plant prosperity. The master controller acting through feed lines routed in the ditch right of way could include an assembly of parts comprising a digital clock means with irrigation interval selector bar; directional valve and pressure switch manifolds cooperating with check station toggles, pilot lighted operational; manual recycling key; pressure gauges, pressure regulator and receiver/compressor unit and including intermediate receivers maintaining system pressure. Any of the described devices will include certain springs, stops and the like to better cycle and operation. The inclusion of the before named pneumatic accessories that maintain and service the air system completes the assembly. A plat of the irrigation tract with lights marking the checking stations, pilot lighted operational, would be of considerable benefit to the larger operation.

Figure 6A:
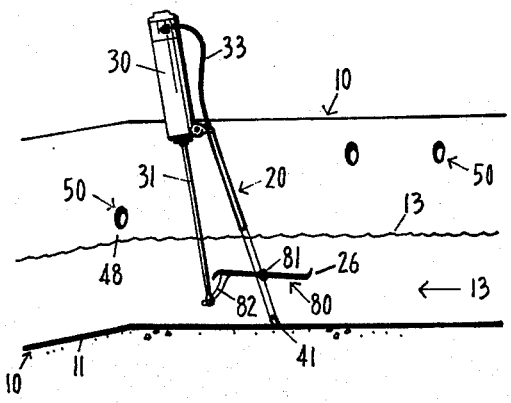
FIG. 6A is a side elevational view thereof, panel open.
Figure 6B:
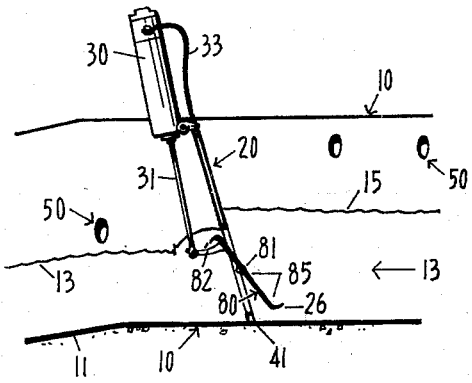
FIG. 6B is a repeat view including off center pivoting.
Figure 7:
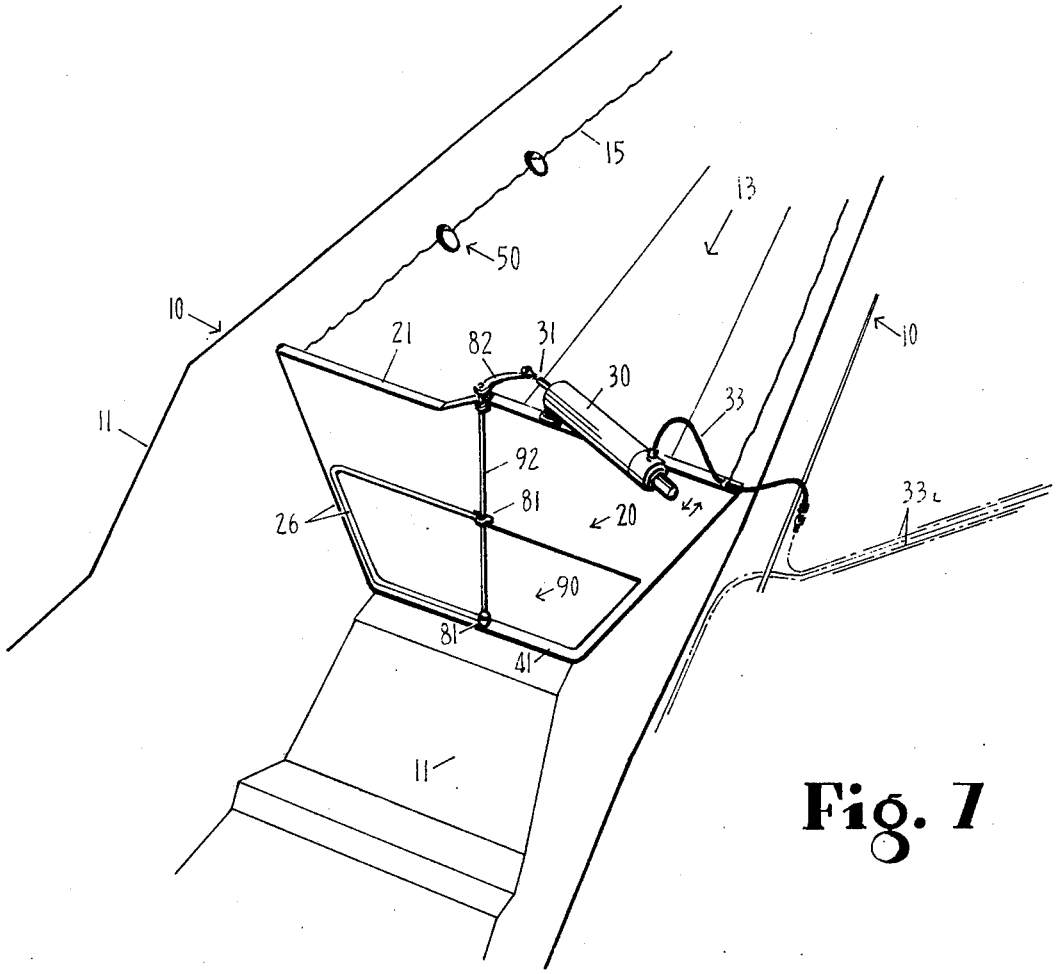
FIG. 7 is a perspective view of a checking structure including powered lower panel, vertical pivotal actuation.

In FIg. 7, the basic check structure, the ram actuator and cycling means described for FIG. 6 is modified to produce a check having lower panel 90 which acts vertically over central pivots affixed to dam 20 and bottom framework 41 to repeat the benefits of balanced reciprocating water pressures just described for FIG. 6A. A shaft extension 92 rising from the top pivot has a laterally projecting lever 82 at its extremity. Cylinder 30 is positioned horizontally on mounting base 23 to aline suitable connections with lever 82 throwing the actuation off dead center. Power feed lines 33*a* are shown routed directly through the fields to the master controller.

Figure 7A:
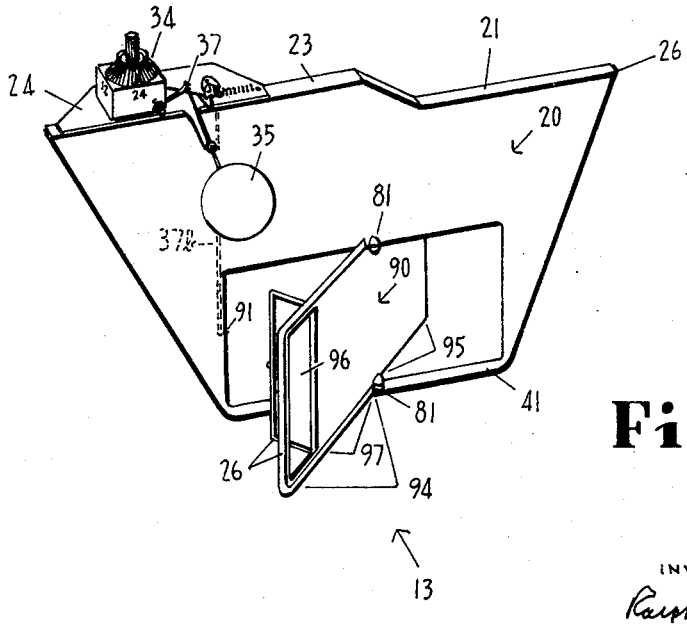
FIG. 7A is a perspective view of a checking structure including off center pivoting and segmented panel.
Figure 3:
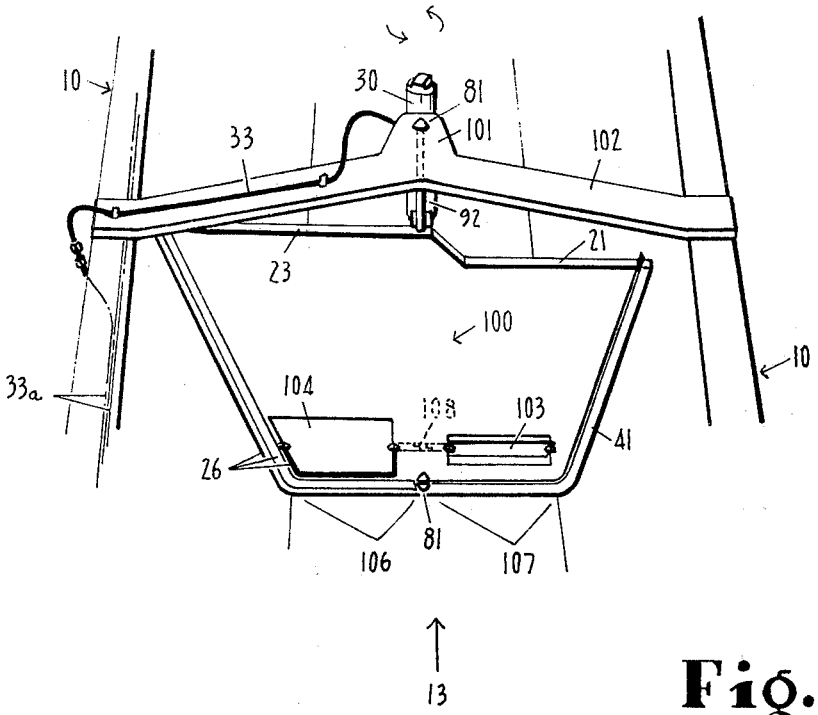
Figure 3B:
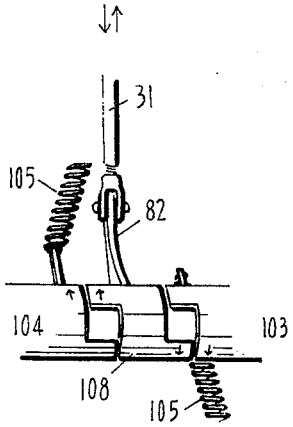
Figure 3A:
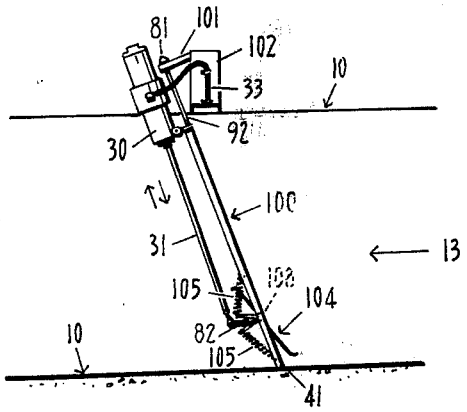

Off center pivoting, as a panel surface manipulation, is extended to include movable segment 96, of FIG. 7A. This arrangement has been described as using reciprocating water pressure differential to reverse the actuation and complete a cycle. Working over pivots 81, surface 94 with segment 96 closed is larger than surface 95 and this forces a closing. Conversely, with the release of segment 96, surface 95 becomes larger than surface 97 and this forces an opening. The degree of automation shown places timer 34 on mounting base 24, and float 35 is located there to perform the duties named by FIG. 2. Acting through linkage 37*b*, timer 34 initiates the release of segment latch 91. Segment 96 can be closed manually, or it can be spring loaded to close, for a recycling.

Still further, it is obvious that panel 90 can be enlarged to fill the ditch. Panel 100, then, is seen in FIG. 8 to function against framework 41, with pivots 81 located there at the bottom and at the top by a span portion interconnecting the ditch walls, as at 102. The top of panel 100 includes spillway 21 and elevated mounting base 23. Span arise and offset 101 creates structural separation permitting actuator component mounting and operational swing. Shaft 92 is the interconnecting support. A stop means can be provided to prevent overswing by panel 100, while reciprocating water pressures working over pivots 81 are modulated through the opening and closing manipulations of segment portions 103 and 104 pivotly depending out of the panel surfaces. The segments are suitably sized to effect the relationship of surfaces 106 and 107. An actuation, by water pressure, in two directions is realized when selective activation of the segments is initiated through interconnecting clutch 108, and FIG. 8B, to create a pressure differential. Segments 103 and 104 are spring loaded at 105 to remain shut while at rest, and panel 100 is pawled to remain open while at rest. To pass water, segment 104, in normal cycle position, remains open. Again, off center pivoting can be incorporated to influence panel or segment position and function. Cylinder 30 is shown single ended and double acting, and is attached uprightly to mounting base 23 with connections to clutch lever 82 throwing the actuation off dead center. A single acting cylinder can be used with a T clutch means selective lateral shift into opposite segment slot portions.

The before named structures, mechanisms and assemblies best satisfy the objects of the invention, and are resorted to as including obvious modification resting within the broadened language of the annexed claims.

What is claimed is:

1. A check structure elevating channeled waters for automatic diversion comprising:

a dam means upper stationary portion interconnecting the walls of a channel liner means above passing waters, a portion of the top surface thereof disposed as a base for actuator component mounting clear of checked water through elevation provided by a lower spillway means adjacent thereto, the surface of said dam having extension in a lower planar framework means, a panel means lower opening portion depending from said dam for support and acting against said framework for a closing, control means interconnecting said lower panel and said mounting base providing selective position in regulating a diversion of water and in controlling the release of accumulated water.

2. The check structure set forth in claim 1 being mechanized by the mounting of an actuator assembly comprising;

a cylinder means with attachments to said lower panel disposed for the operation thereof, a directional valve means set apart from and plumbed to said cylinder for the cycling thereof, a timer means for the measuring of irrigation intervals having linkage means engagement with said directional valve activating cycle, a float means cooperating with said timer to activate the measuring of irrigation interval when buoyed by high water, a pressure regulator means set apart from and plumbed to said directional valve, a receiver means set apart from and plumbed to said pressure regulator.

3. The check structure of claim 1 being adapted to the earth ditch through location within a transverse segment portion of the channel liner that includes a floor projection means for the spill of water.

4. The mechanism of claim 2 with the float activator including linkage means engagement with said directional valve for the selective actuation of said cylinder producing limited pressurization, rest and release to thereby position said lower panel for the stabilizing of a checked water line.

5. The check structure of claim 1 with the lower panel disposed vertically acting through track engagement means depending from the dam and bottom offset roller means locating in a track niche for a closing while producing initial break away in the opening thereof freeing said panel for sliding movement.

6. The mechanism of claim 2 with the pressure regulator and the receiver being a remote power assembly located apart from a plurality of checks and serving said checks through manifold connections to feed lines routed along the ditch right-of-way.

7. The check structure of claim 1 with the lower panel disposed to act horisontally over side pivot means depending centrally from said dam to thereby create equal surfaces reciprocating water pressure and seal for limited pivotal movement while acting against the dam for a closing, a lever means projecting from said panel to provide connections throwing the actuation thereof off dead center.

8. The mechanism of claim 2 with the component assembly for the powering and cycling of the check actuator being relocated and consolidated apart from the field checks in a centralized programed controller means serving the system through manifold connections to feed lines routed accessible in the ditch excavation prior to the laying of the ditch liner means.

9. The combination of claim 7 with the lower panel being further characterized by unequal surfaces created in the off center placement of the pivots to thereby produce unequal reciprocating water pressure and seal effecting a one way actuation of the panel.

10. The check structure of claim 1 with the lower panel disposed to act vertically over top and bottom pivot means depending centrally from the dam to thereby create equal surfaces reciprocating water pressure and seal for limited pivotal movement while acting against the dam for a closing, the top pivot having upward extension in a shaft member with lever means projecting therefrom providing connections throwing the actuation thereof off dead center.

11. The mechanism of claim 2 with the component assembly for the powering and cycling of the check actuators comprising the completely automated sequent means controlling irrigation systems function through manifold connections to feed line means routed directly through the fields while including intermediate receiver means maintaining system power.

12. The combination of claim 10 with the lower panel being further characterized by unequal surfaces created in the off center placement of the pivots to thereby produce unequal reciprocating water pressure and seal effecting a one way actuation of the panel.

13. The combination of claim 12 with the lower panel being further characterized by an opening and closing segment means depending out of the larger of its surfaces to alter the surface relationship working over the pivots by an amount producing selective unequal reciprocating water pressure and seal effecting a two way actuation of the panel, a pawled latch means disposed maintaining panel and segment closure against said dam, the mounting of a timer means in communication with said latch for the selective release thereof, and the mounting of a float activator and linkage means in communication with said timer to initiate the measuring of irrigation interval.

14. A check structure elevating channeled waters for a diversion comprising;

a planar framework means having position within a channel liner means and cooperating with a channel span member having midportion arise and offset, a panel means disposed to act vertically over top and bottom pivot means depending centrally from said framework and span to thereby create equal surfaces reciprocating water pressure and seal for limited pivotal movement while acting against said framework for a closing, a portion of the top surface thereof disposed as a base for actuator component mounting clear of checked water through elevation provided by a lower spillway means adjacent thereto, the top of the panel being spaced apart from said span with a shaft connection therebetween including projecting means throwing the actuation thereof off dead center.

15. The combination of claim 14 with the panel being further characterized by unequal surfaces created by the off center placement of the pivots to thereby produce unequal reciprocating water pressure and seal effecting a one way actuation of the panel.

16. The combination of claim 15 with the panel being further characterized by an opening and closing segment means depending out of the larger of its surfaces to alter the surface relationship working over the pivots by an amount producing selective unequal reciprocating water pressure and seal effecting a two way actuation of the panel.

17. The check structure set forth in claim 14 being mechanized by the mounting of an actuator assembly comprising;

cooperating opening and closing segment means depending out of each of the panel surfaces disposed for limited pivotal movement altering the surface relationship by an amount producing selective unequal reciprocating water pressure and seal effecting a two way actuation of the panel, said segments being spring loaded to maintain a closing while at rest, a clutch means interconnecting the segments with projecting means providing connections throwing the actuation thereof off dead center.

18. A ditch structure regulating the diversion of head waters comprising the dam and control means of claim 1 with said lower movable panel being a plurality of interacting channel members disposed to close against the dam and to open in sequent means fragmenting water pressure and seal.

19. The check structure of claim 18 being mechanized by the mounting of an actuator assembly comprising;

a longitudinal rack means depending from the control, mobile paddle wheel means disposed downstream by a supporting member having attachments to the dam permitting said paddle wheel to follow a changing water line through self-contained buoyancy, said paddle wheel being powered for rotation by the spill of water and by the force in the release of accumulated water, a mobile driveshaft and extremity gear means in mechanical advantage interconnecting the paddle wheel and the control rack for the selective actuation and positioning of said lower panel.

20. The check mechanism of claim 2 with the pneumatic actuator means being a hydraulic actuator means.

21. The check structure of claim 1 with said control being further characterized by a longitudinal rack means cooperating with the mounting of a motor and gear means disposed for the actuation of the lower panel.

22. The check mechanism of claim 2 with said float activator means being a water powered trip activator comprising a bucket means cooperating with the spill of water.

23. The check mechanism of claim 2 with said float activator means being a solenoid activator means.

24. The check mechanism of claim 1 with the diversion of water including a plurality of valve members perforating the ditch wall behind said dam and cooperating with a checked water line for the selective distribution of water comprising;

an open conduit means having location in the earth channel wall to project an amount automatically perforating the laying of a channel liner means, a valve means being an open ended tube with intermediate flex joint means therebetween, one end disposed with attachments to the conduit permitting an opposite extremity selective elevation manipulation to vary the flow of water for metering and shutoff.

25. The valve means of claim 24 being a tube with depending curved flapper means disposed in the extremity thereof to nest against the tube wall for a full opening and in selective position.

* * * * *